US005088962A

United States Patent [19]

McCartney

[11] Patent Number: 5,088,962

[45] Date of Patent: Feb. 18, 1992

[54] CREDIT CARD TRANSACTION FORM SET

[75] Inventor: Larry G. McCartney, Buckhannon, W. Va.

[73] Assignee: Moore Business Forms, Inc., Grand Island, N.Y.

[21] Appl. No.: 615,171

[22] Filed: Nov. 19, 1990

[51] Int. Cl.[5] ..... B41L 1/20

[52] U.S. Cl. ..... 462/18; 462/17; 462/69

[58] Field of Search ..... 282/9 R, 8 R; 283/105, 283/98; 462/1 R, 1 A, 8 C, 28 R

[56] References Cited

U.S. PATENT DOCUMENTS

| | | | |
|---|---|---|---|
| 3,022,094 | 2/1962 | Kehoe | 282/22 |
| 4,403,793 | 9/1983 | McCormick et al. | 283/105 |
| 4,611,826 | 9/1986 | Breen | 282/8 R |
| 4,687,228 | 8/1987 | Van Malderghem et al. | 282/9 R |
| 4,903,989 | 2/1990 | McCormick | 282/9 R |

*Primary Examiner*—Timothy V. Eley
*Assistant Examiner*—Willmon Fridie, Jr.
*Attorney, Agent, or Firm*—Nixon & Vanderhye

[57] ABSTRACT

A credit card transaction form set provides a customer copy form which is attached to any and all carbon sheets in the set in a readily detachable manner so that the complete carbon sheets can be removed from the customer copy if desired. The customer copy overlays a bottom, OCR bond form, and preferably is a CF carbonless sheet. The set may be either three part or four part, with the top form a CB carbonless sheet, and the fourth part—if provided—a CFB carbonless sheet. A S/F carbon sheet disposed between the customer copy and the OCR bond is attached to the customer copy by permanent adhesive adjacent an edge of the customer copy opposite its attachment to the other forms of the set, and the customer copy is connected by perforations to the carbon sheet.

21 Claims, 2 Drawing Sheets

FIG. 1
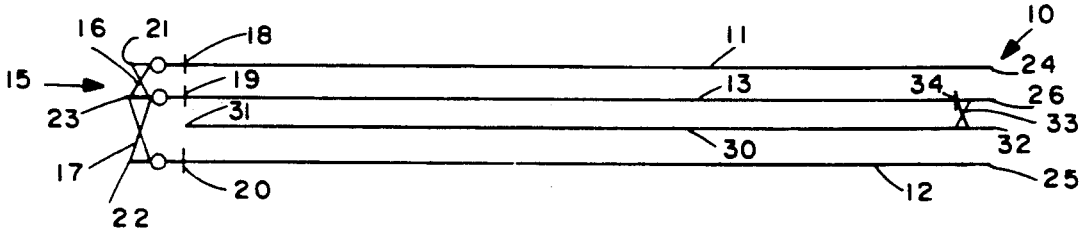
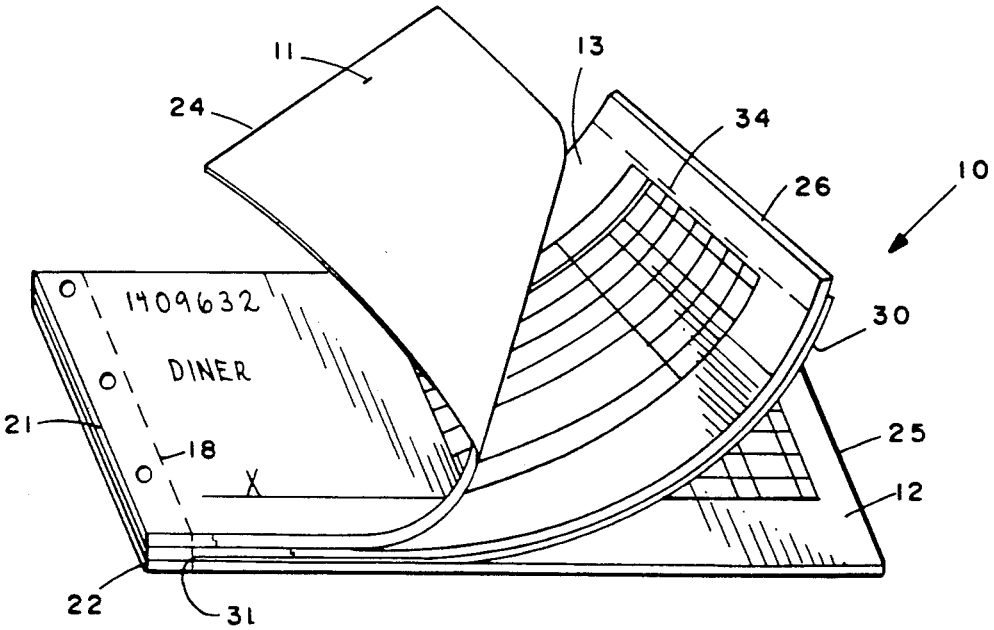
FIG. 2
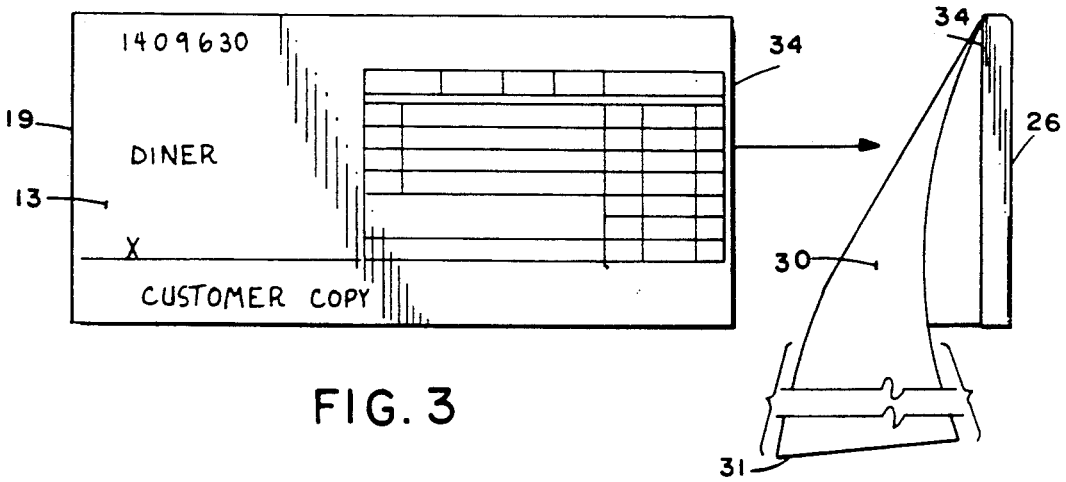
FIG. 3

CREDIT CARD TRANSACTION FORM SET

BACKGROUND AND SUMMARY OF THE INVENTION

One of the major design considerations for modern credit card transaction form sets is to minimize the possibility of credit card fraud. A number of approaches have been taken to this problem in the past, none of which are entirely acceptable from both the fraud prevention and maximum utility standpoints.

One prior art approach is to utilize all carbonless sheets in the form set. While this means that there are no carbon sheets from which a criminal might obtain a credit card number, such an approach is not acceptable if the bank copy of the form set must be OCR readable.

A second prior art approach is to provide as the only carbon in the form a carbon backing to the customer copy. While this does allow use of an OCR bank copy, the carbon backing on the customer copy can smudge the customer's clothing, wallet, or other papers. Also, it is a disincentive to the customer retaining the customer copy since, if unfolded, the carbon coating may smudge other papers retained with the form.

The third prior art approach, disclosed in U.S. Pat. No. 4,403,793, shows a set in which any carbon sheets are perforated at a mid-point of the expected card number imprint thereon, so that when the carbon sheets are detached from the set, neither the retained copy nor the carbon provided to the customer will have a complete credit card number. With such a construction, a perforating operation in the carbon sheets is required, and special instructions are necessary to the establishment personnel using the form sets for the first time regarding how detachment is to occur and to whom various components of the set are to be given, two detaching actions commonly being required. Also, since the customer is typically handed the carbon sheets independent of a customer copy of the form, many customers have a tendency to merely leave the carbon sheets at the establishment. If the employee conducting the transaction is dishonest, this allows the employee to defeat the fraud-minimizing intent of the form set by picking up the discarded carbon sheets, and combining them with the carbon sheet portion retained with the establishment copy of the form.

According to the present invention, a credit card transaction form set is provided which overcomes all of the drawbacks of each of the prior art constructions discussed above. The form set according to the invention provides detachment of all carbon sheets associated with the form with the customer copy of the form. Yet, because the carbon is not integral with the customer copy of the form, and can be readily detached therefrom, the customer can dispose of the carbon at his or her convenience. For example, when originally presented with the customer copy of the form with the carbon sheet on the back thereof, the customer may fold the form in half so that the carbon is facing inside, and take the form away from the establishment at which the transaction has occurred. Later, when the customer seeks to file the form, the customer can remove the carbon and discard it. At the same time, the form set provides an OCR readable bank copy.

According to one aspect of the present invention, a credit card transaction form set is provided comprising at least top, bottom, and a first middle transaction forms, each having edges. The set further comprises:

first attachment means for operatively attaching the forms together adjacent a first overlying edge of each; first ready detachment means formed in each form on the opposite side of the first attachment means from the first edge thereof; a transfer sheet disposed between the first middle and bottom forms for transferring information impressed on the top form to the bottom form; second attachment means for attaching the transfer sheet to the first middle form adjacent a second edge thereof, opposite the first edge; and second ready detachment means for allowing ready detachment of the transfer sheet from the first middle form, when desired. The attachment means preferably comprise permanent adhesive, and the ready detachment means preferably comprise perforations The bottom form is preferably 24–28 OCR bond, and the transfer sheet is a S/F OCR carbon sheet. Preferably, the top form is a self-contained CB carbonless sheet, while the first middle form is a CF carbonless sheet. If a four-part set is provided, a second middle form—disposed between the top form and first middle form—preferably comprises a CFB carbonless sheet.

According to another aspect of the present invention, a credit card transaction form set comprising at least top, bottom and first middle transaction forms comprises: first attachment means for operatively attaching the forms together adjacent first overlying edges of each; first ready detachment means formed in each form on the opposite side of the first attachment means from the first edge thereof; the bottom form comprising an OCR bond sheet; at least one transfer sheet, capable of transferring OCR readable characters to the bottom form from impressions applied to the top form; and any and all complete transfer sheets associated with the set detachable with the first middle form when the first ready detachment means are severed, and readily separable from the first middle form.

It is the primary object of the present invention to provide an effective credit card transaction form set which is capable of producing an OCR readable bank copy, minimizes the chances of credit card fraud, and minimizes the chances of smudging by retained carbon sheets. This and other objects of the invention will become clear from an inspection of the detailed description of the invention, and from the appended claims.

BRIEF DESCRIPTION OF THE DRAWINGS

FIG. 1 is a side schematic view illustrating a first embodiment—a three-part construction—of an exemplary credit card transaction form set according to the present invention;

FIG. 2 is a top perspective view of the form set of FIG. 1;

FIG. 3 is a top view of the customer copy and detached carbon sheet of the form set of FIGS. 1 and 2;

DETAILED DESCRIPTION OF THE DRAWINGS

Figure 4:
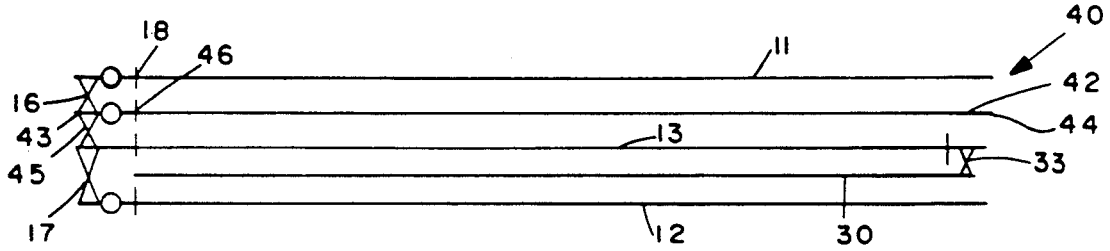
FIG. 4 is a view like that of FIG. 1 for a second exemplary form set construction—four-part—according to the present invention.

An exemplary credit card transaction form set according to the present invention is shown generally by reference numeral 10 in FIGS. 1 and 2. The form set comprises at least top 11, bottom 12, and a first middle 13 forms. The forms are preferably quadrate, having four perpendicular edges. At first side edges 15 are provided first attachment means, such as permanent glue strips 16, 17 for attaching the forms 11-13 together. The glue strip 16 attaches the forms 11, 13, and the glue strip 17 attaches the forms 13, 12 together, in overlying relationship. The forms 11-13 are preferably of approximately identical size.

The form set 10 also comprises first ready detachment means formed in each form 11-13 for allowing detachment thereof from the rest of the set. Such ready detachment means preferably comprise perforations 18 through 20, respectively, formed in each of the forms on the opposite side of the first attachment means 16, 17 as first overlapping edges of the forms 11-13. The first overlapping edges are indicated by reference numerals 21-23 in FIG. 1. Each of the forms 11-13 also include second edges opposite the first edges (and parallel thereto), the second edges being denoted by reference numerals 24 through 26 in FIGS. 1 and 2.

Another significant element of the form set 10 comprises the transfer sheet 30. The transfer sheet 30 has a first edge 31 thereof, and a second edge 32. The transfer sheet 30 preferably has slightly smaller dimensions than the middle form 13, at least in the longitudinal dimension of the form (between the first and second edges thereof). For example, the edge 31 terminates short of the perforations 19, 20 and a second edge 32 terminates just short of the second edges 25, 26 of the forms 12, 13, respectively.

Associated with the transfer sheet 30 is a second attachment means 33, preferably comprising a permanent adhesive, for attaching the transfer sheet 30 to the middle form 13 adjacent the second edge 26 thereof. Second ready detachment means are also provided, preferably in the form of perforations 34, for allowing ready detachment of the main body of the form 13 from the second edge 26 thereof, and the transfer sheet 30.

In a preferred embodiment, the bottom form 12 comprises the bank copy of the set 10, and is of 24-28 lb. OCR bond. The transfer sheet 30 preferably is single faced (S/F) OCR carbon paper, which is capable of transferring OCR readable characters to the form 12 when the characters are written on the top form 11. The top form 11 preferably comprises a self-contained face with coated back (CB) carbonless sheet, while the first middle form 13 comprises a coated face (CF) carbonless sheet. The top form 11 typically is the establishment copy of the form, while the first middle form 13 is the customer copy.

In use of the form set 10, when a purchase is to be charged at an establishment, e.g. a restaurant, a customer's credit card is imprinted on the form, including a credit card number, customer's name, etc. The appropriate cost of the goods or services purchased is indicated on the appropriate part of the top form 11, which is transferred to the middle form 13 by the CB/CF coatings, and is transferred in OCR readable characters to the bottom form 12 by the carbon sheet 30. After the transaction has been completed and the customer has signed his or her name to the form set, the middle form 13 is grasped adjacent the second edge 26 thereof, and, by a pulling or tearing action, the middle form 13 is detached from the rest of the form set 10. To facilitate this function, the perforation line 34 can be stronger than the perforation line 19. Once the middle form—customer copy 13—has been detached, with the carbon sheet 30 connected thereto, it may be folded up so that the carbon sheet 30 faces come in contact with each other, and then transported by the customer to another location. Once at another location, and/or when it is desirable for the customer to file the form 13, the customer detaches the carbon sheet 30 from the form 13 along the perforation line 34, and discards the sheet 30. Thus, the possibility of credit card fraud is minimized, and the utility of the form is maximized, while the probability of smudging by the carbon is minimized.

FIG. 4 illustrates a second exemplary embodiment of the form set 40, which is essentially identical to the form set 10 except that it is a four-part form set. The same structures as illustrated in the FIGS. 1 through 3 embodiment are illustrated by the same reference numerals in FIG. 4.

In FIG. 4, the form set 40 contains a second middle form 42 which has first and second edges 43, 44 thereof. As part of the first attachment means, a permanent adhesive strip 45 is provided for connecting the second middle form 42 to the first middle form 13, while the glue strip 16 connects the top form 11 to the second middle form 42. A perforation 46 in the second middle form 42 is in alignment with the perforations 18 through 20. The form 42 preferably is a CFB carbonless sheet.

Figure 5:
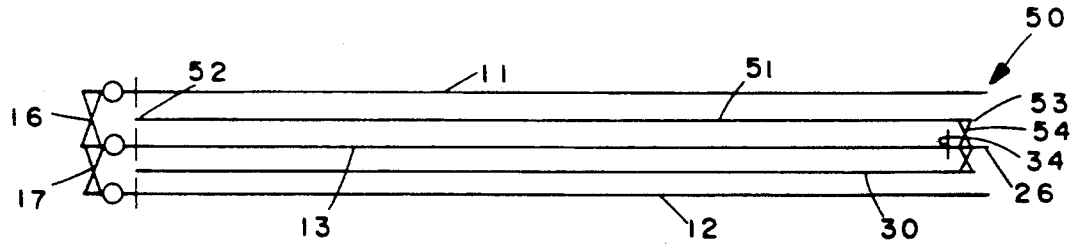
FIG. 5 is a view like that of FIG. 1 for a third exemplary embodiment of a form set according to the invention.

A third exemplary embodiment of credit card transaction form set 50 according to the invention is illustrated in FIG. 5. The form set 50 is essentially identical to the form set 10 except that instead of transfer of data from the top form 11 to the middle form 13 being accomplished by a CB/CF coating system, another transfer sheet 51 is provided, having first and second edges 52, 53 thereof. The transfer sheet 51 is essentially identical to the sheet 30 in size and construction, and it is attached to the form 13 by the permanent adhesive strip 54 outside of the perforation 34. In this way, when the customer copy 13 is detached from the form set 50, all and complete transfer (carbon) sheets associated with the form set are detached with the customer copy 13. They may then subsequently be readily detached therefrom and discarded, merely by separation along the perforation line 34.

It will thus be seen that according to the present invention an advantageous credit card transaction form set has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A credit card transaction form set comprising at least top, bottom, and a first middle transaction forms each having edges, including first and second opposite edges;

first attachment means for operatively attaching said forms together adjacent said first, overlying, edges of each;

first ready detachment means formed in each form on the opposite side of said first attachment means from said first edge thereof;

a transfer sheet disposed between said first middle and bottom forms for transferring information impressed on said top form to said bottom form;

second attachment means for attaching said transfer sheet to said first middle form adjacent said second edge thereof; and second ready detachment means for allowing ready detachment of said transfer sheet from said first middle form, when desired.

2. A set as recited in claim 1 wherein said second ready detachment means comprises perforations formed in said first middle form adjacent said second attachment means and on the opposite side of said second attachment means from said second edge; and wherein said first ready detachment means comprises first perforation means.

3. A set as recited in claim 2 wherein said bottom form is constructed of OCR paper, and wherein said transfer sheet is capable of transferring OCR readable characters to said bottom form.

4. A set as recited in claim 1 consisting of said top, bottom, and first middle forms, and said transfer sheet.

5. A set as recited in claim 4 wherein said top form comprises a SC CB carbonless sheet, and said first middle form comprises a CF carbonless sheet.

6. A set as recited in claim 1 wherein said attachment means comprise adhesive.

7. A set as recited in claim 1 further comprising a second middle form between said top and first middle forms.

8. A set as recited in claim 7 wherein said second middle sheet comprises a CFB carbonless sheet, and wherein said top form comprises a SC CB carbonless sheet, and wherein said first middle form comprises a CF carbonless sheet.

9. A set as recited in claim 1 wherein said transfer sheet comprises a single face carbon sheet.

10. A set as recited in claim 1 wherein said bottom form comprises 24–28 lb. OCR bond, and wherein said transfer sheet comprises S/F OCR carbon.

11. A set as recited in claim 1 wherein said transfer sheet is smaller than said first middle form, said transfer sheet having a first edge thereof located on the opposite side of said first ready detachment means from said first attachment means.

12. A set as recited in claim 11 wherein said transfer sheet second edge is located closer to said second ready detachment means than the second edge of said first middle form.

13. A set as recited in claim 1 wherein all and complete transfer sheets associated with said set detach with said first middle form when said first middle form is detached along said first ready detachment means.

14. A set as recited in claim 1 wherein said top, bottom, and first middle transaction forms are unconnected to each other at said second edges thereof, and said transfer sheet is connected only to said first middle transaction form, at said second edge thereof.

15. A set as recited in claim 13 wherein said top, bottom, and first middle transaction forms are unconnected to each other at said second edges thereof, and said transfer sheet is connected only to said first middle transaction form, at said second edge thereof.

16. A credit card transaction form set comprising at least top, bottom, and a first middle transaction forms, each having edges;

first attachment means for operatively attaching said forms together adjacent first overlying edges of each;

first ready detachment means formed in each form on the opposite side of said first attachment means from said first edge thereof;

said bottom form comprising an OCR bond sheet;

at least one transfer sheet, capable of transferring OCR readable characters to said bottom form from impressions applied to said top form; and any and all complete transfer sheets associated with said set detachable with said first middle form when said first ready detachment means are severed, and readily separable from said first middle form.

17. A set as recited in claim 16 wherein said transfer sheet is connected to said first middle form by adhesive.

18. A set as recited in claim 17 wherein said transfer sheet is connected to said first middle form between said first middle form and said bottom form adjacent a second end of said first middle form, opposite said first edge thereof; and further comprising a perforation formed in said first middle form adjacent said adhesive to allow ready detachment of said first middle form from said transfer sheet.

19. A set as recited in claim 16 wherein said transfer sheet comprises the only transfer sheet in said set; and wherein said first middle sheet comprises a CF carbonless sheet.

20. A set as recited in claim 19 further comprising a second middle form disposed between said top form and said first middle form, said second middle form comprising a CFB carbonless sheet, and said top form comprising a SC CB carbonless sheet.

21. A set as recited in claim 20 wherein said attachment means are all permanent adhesive.

* * * * *